US005485923A

United States Patent [19]

Schrepfer

[11] Patent Number: 5,485,923

[45] Date of Patent: Jan. 23, 1996

[54] DRUM FOR PARTICULATE HANDLING WITH FINES COLLECTOR

[75] Inventor: M. W. Schrepfer, Elk Grove Village, Ill.

[73] Assignee: UOP, Des Plaines, Ill.

[21] Appl. No.: 282,449

[22] Filed: Jul. 29, 1994

[51] Int. Cl.[6] ..... B07B 1/00

[52] U.S. Cl. ..... 209/235; 209/373; 209/417

[58] Field of Search ..... 209/702, 684, 209/687, 417, 420, 235, 373

[56] References Cited

U.S. PATENT DOCUMENTS

| | | | |
|---|---|---|---|
| 484,621 | 10/1892 | Wall | 209/417 |
| 2,679,935 | 6/1954 | Manchan | 209/417 X |
| 3,409,411 | 11/1968 | Mosley et al. | 23/288 |
| 4,720,473 | 1/1988 | Welch et al. | 502/21 |
| 4,737,269 | 4/1988 | Bischoff | 209/23 |
| 4,889,619 | 12/1989 | Lynch | 209/373 X |
| 4,942,277 | 7/1990 | Narberes | 209/235 X |
| 5,082,552 | 1/1992 | Welch et al. | 208/216 |
| 5,277,318 | 1/1994 | Smalley, Jr. et al. | 209/417 X |
| 5,293,837 | 3/1994 | Caldwell | 209/373 X |
| 5,332,102 | 7/1994 | Sennett et al. | 209/417 |

FOREIGN PATENT DOCUMENTS

| | | | |
|---|---|---|---|
| 6140/160 | 1/1894 | Germany | 209/373 |

*Primary Examiner*—D. Glenn Dayoan

*Attorney, Agent, or Firm*—Thomas K. McBride; John G. Tolomei

[57] ABSTRACT

A drum for the storage and transportation of particulate materials aids in the removal of fine particles and dust from the particulate material during transport by the use of a screen arrangement and trap in the bottom of the drum.

4 Claims, 1 Drawing Sheet

DRUM FOR PARTICULATE HANDLING WITH FINES COLLECTOR

FIELD OF THE INVENTION

This invention relates to handling and transportation of particulate material. More specifically this invention relates to containers for storing and handling particulate material.

BACKGROUND OF THE INVENTION

Particulate material in the form of cylinders, spheres and other regular and irregular shapes are routinely used as catalysts and adsorbents in processing operation such as chemical reactions and separations. The particulate material ordinarily has a mean diameter of less than a quarter inch. The particulate material is normally shipped in a container at least from the point of manufacture to the point of installation where it is loaded in a processing or reactor vessel. A number of catalyst and adsorbents, particularly clay based catalyst, are susceptible to abrasion and/or breakage as a result of handling during the shipping process. Thus, vibration or other disturbance of the catalyst as it is shipped can generate undersized particles (generally referred to as fines) and dust during the transport.

This undersized particulate material and dust are objectionable in processes for a number of reasons. Fines or particulate material may slip through screens or other retaining devices within the processing vessels that are meant to retain the particles. As process fluids move through the processing vessel, the fine materials become entrained therein and can be passed to other equipment such as valves, pumps, and compressors where the fine particles may cause plugging and erosion. More directly, fines and dust within a processing bed can increase pressure drop as fluids pass therethrough. As a result, precautions are normally taken when loading particulate material from drums into a processing vessel to remove fines and dust that can interfere with the operation of the processing equipment. In addition, the fine material within a particle bed may cause channeling and poor distribution of fluids through the bed.

Methods have been employed by those skilled it the art of catalyst handling and loading to remove or reduce fines as catalyst is loaded into reactor vessels. U.S. Pat. No. 4,737,269 issued to Bischoff shows a suction apparatus for removing fines as catalyst is unloaded from drums into vessels.

BRIEF DESCRIPTION OF THE INVENTION

It has recognized that fine material whether present initially in a drum of particulate material or generated during the transportation process will normally settle to the bottom of a drum. Rolling of the drums during the typical manual handling of the drums further causes the fine material to settle to the bottom of the drum. In accordance with the invention, the fine materials and dust that accumulates in a drum of particulate material can be separated during transit by providing a screen and trap arrangement at the bottom of a drum. The openings of the screen are sized to allow fine materials to pass through the screen while maintaining the larger particulate materials above the screen. By positioning a trap at the outside of the screen, the fine materials collected during the transportation process are retained in the drum as the remainder of the particulate material is emptied for use in a desired application.

Accordingly, in one embodiment this invention is a container for particulate material that comprises a bottom and a side wall. The container is improved by positioning a screen means at the bottom of the container. The screen has openings that are smaller than the particulate material. The majority of the particulate material is held in the container. A trap position at the periphery of the screen collects particles that pass through the screen and retains the particle when the particulate material is emptied from the top of the drum.

This invention may be applied to the handling and transportation of the any type of particulate material and any type of drum. This invention finds its greatest use in the transportation of particulate material that is subject to abrasion and breakage and is most beneficially used in applications where undersized particles are objectionable. The type of containers to which the invention may be applied include any container having side walls and a bottom. The typical application will be in cylindrical drums made of steel, fiber or combinations thereof.

The screen element used in the bottom of the drum is arranged to provide a small volume for retaining fine particulate material. In most applications, the amount of fines and dust generated during the transportation or loading of particulate material is relatively small. Therefore, the volume below the screen for retaining such material is relatively low in relation to total volume of the container. The screen and the volume for retaining particulate material may be provided in any manner that provides suitable size openings for excluding the desired size of particulate material from passing through the screen member and an adequate volume in the trap for retaining the amount of fines expected to be separated and collected during transport of the particulate material. Possible arrangements for providing the screen and collection chamber include perforating the bottom of the container and providing a sealed chamber below the perforated bottom. The more typical arrangement for the screen and collection chamber would use an ordinary screen element that fits into the bottom of the container and is surrounded at its periphery by a ring that provides a trap for retaining particulate material when the container is emptied. A space may be maintained between the screen and the bottom of the container by spacers that offset the screen and support the screen from the bottom of the container. The screen may extend over a portion or the entire bottom of the container.

Additional objects, embodiments, and details of the invention will be appreciated from the following detailed description of the preferred embodiment.

DETAILED DESCRIPTION OF THE PREFERRED EMBODIMENT

Figure 1:
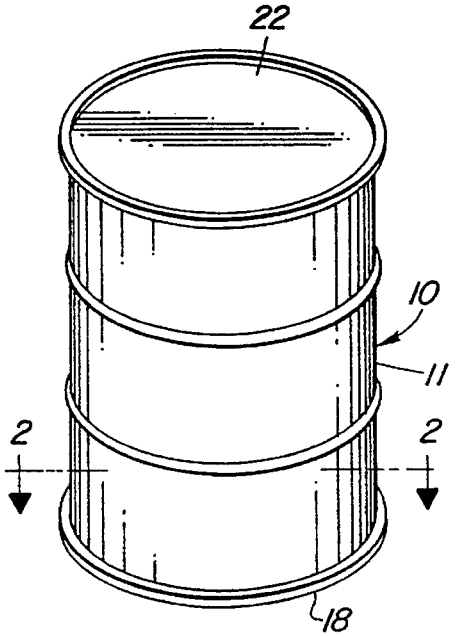
FIG. 1 is a container for particulate material in the form of an ordinary drum.

FIG. 1 shows a metal, cylindrical drum 10. The drum has a flat top 22, a cylindrical sidewall 11 and a flat bottom 18. The cylindrical side wall, top and bottom define an interior volume of the drum. The drum is ordinarily filled with particulate material and sealed for transport.

Figure 2:
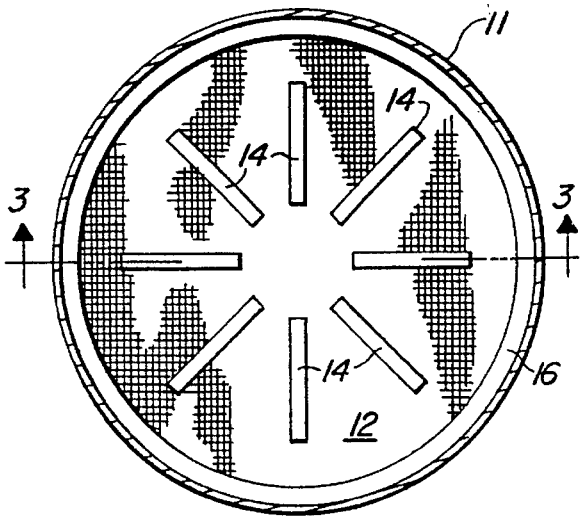
FIG. 2 is a horizontal section taken along lines 2—2 of FIG. 1 and showing a plan view at the bottom of the drum.

As shown in FIG. 2, this invention modifies the ordinary drum 10 by the addition of a screen 12 at the bottom of the drum. Screen 12 in this particular arrangement is circular and extends around the periphery of sidewall 11. Screen 12 is supported at several points by spacer bars 14. Spacer bars 14 are preferably arranged in a regular pattern about the bottom of the drum. A ring 16 surrounds the outer periphery of screen 12 and is sealed against the inside cylindrical wall of drum 10.

Figure 3:
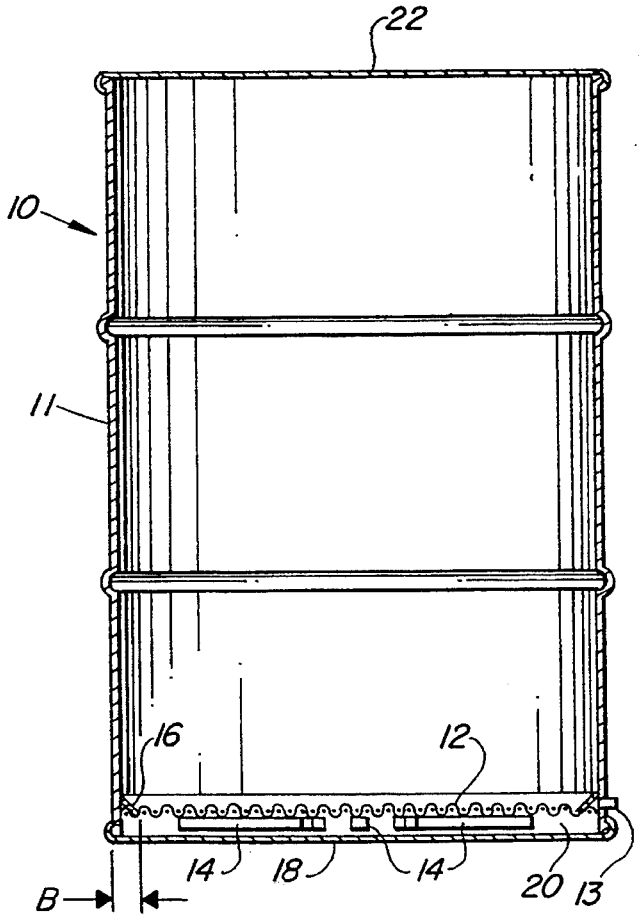
FIG. 3 is a vertical section of the drum taken along lines 3—3 of Figure.

FIG. 3 shows the relative vertical position of screen 12 within drum 10. Spacer bars 14 hold screen 14 above bottom 18 by a distance equal to the height of the spacers. For most applications, a spacer height of about 1 inch will provide an adequate collection volume 20 below screen 12 and above bottom 18. Ring 16 has an outer edge that encircles the inside of cylindrical sidewall 11. Ring 16 has a frustroconical shape and provides the trap for retaining fines and dust. The outer edge of ring 16 is located above the screen 12 to form a volume that traps dust and fine particles when the drum is inverted for unloading. During the unloading process, as the drum is put on its side and possibly rolled during manual handling, all of the fine particulate materials collected in space 20 move outward to the edge of the drum. Once the drum is inverted, ring 16 together with the adjacent portion of sidewall 11 acts as a trough that retains fines and dust while the desired size particles are emptied for use in their intended application.

For most applications, ring 16 will extend horizontally over screen 12 by a distance equal to dimension B, which is generally about two inches, and will extend upward at an included angle at from 30 to 45 degrees from the horizontal. Where a large amount of fines are expected the size of ring 16 may be increased as is necessary to provide an adequate retaining volume for fines and dust when the drum is inverted.

Ring 16 and screen 12 may be permanently mounted in the bottom of the drum or may be removable. In the case of the permanent mounting of the screen and ring, a drain opening 13 may be provided in the wall of drum 10 below the screen to empty fines and dust before reloading of the drum after use. Alternatively, ring 16 may be made of light gauge spring material that permits its removal between unloading and loading for emptying of fines and dust from the drum. In this type of arrangement the outer edge of ring 16 resiliently contacts the inside of the cylindrical side wall of the drum 10. In addition, ring 16 may be attached to the screen by welding or brazing or other suitable method. Ring 16 can also be a separate element that is resiliently placed against the screen and retained in position by pressure against sidewall 11. Preferably, ring 16 is welded to screen 12 to prevent any gap from developing between the screen and the bottom edge of the ring that would permit larger particulate material to collect within the trapped space formed by the ring.

What is claimed is:

1. A drum for holding particulate material, said drum comprising:

a cylindrical sidewall, a top and bottom defining an interior volume;

a screen located parallel to and above said bottom and extending toward said sidewall, said screen having openings smaller than said particulate material;

a spacer to support said screen from said bottom;

an angled ring having an inner edge sealed against the top of said screen and an outer edge located above said inner edge and encircling the inside of said cylindrical sidewall;

means for removing particulate material from said trap comprising a drain opening in the side of said drum.

2. The drum of claim 1 wherein said ring extends inwardly from said cylindrical side wall a distance of about 2 inches.

3. A drum for holding particulate material, said drum comprising:

a cylindrical sidewall, a top and bottom defining an interior volume;

a screen located parallel to and above said bottom and extending toward said sidewall, said screen having openings smaller than said particulate material;

a spacer to support said screen from said bottom;

an angled ring having an inner edge sealed against the top of said screen and an outer edge located above said inner edge and encircling the inside of said cylindrical sidewall; and means for removing particulate material from said trap, wherein said angled ring is made of a resilient material that biases said ring against said cylindrical side wall for removal from said drum to provide said means for removing particulate material from said trap.

4. The drum of claim 3 wherein said ring extends inwardly from said cylindrical side wall a distance of about 2 inches.

* * * * *